United States Patent [19]

Kreiseder

[11] Patent Number: 4,706,835

[45] Date of Patent: Nov. 17, 1987

[54] CLOSURE WITH TOP CUT TAMPER EVIDENT FEATURE

[75] Inventor: Walter J. Kreiseder, Barrington, Ill.

[73] Assignee: Courtesy Mold & Tool Corporation, Wheeling, Ill.

[21] Appl. No.: 38,893

[22] Filed: Apr. 16, 1987

[51] Int. Cl.[4] ..... B65D 51/22

[52] U.S. Cl. ..... 220/258; 220/253; 220/214; 220/267; 222/83

[58] Field of Search ..... 220/214, 258, 253, 277, 220/267; 222/83, 541; 215/252

[56] References Cited

U.S. PATENT DOCUMENTS

| | | | |
|---|---|---|---|
| 378,349 | 2/1888 | Williamson | 220/258 |
| 2,054,033 | 9/1936 | Conner et al. | 215/252 |
| 2,560,793 | 7/1951 | Greene | 215/252 |
| 3,261,504 | 7/1966 | Sabaka | 222/83 |
| 3,355,069 | 11/1967 | Miles | 222/83 |
| 3,402,855 | 9/1968 | Schroeder | 222/83 |
| 3,463,347 | 8/1969 | Kerr | 220/277 |
| 3,726,432 | 4/1973 | Gentile . | |
| 3,874,580 | 4/1975 | Weatherhead, III | 220/253 |
| 3,877,604 | 4/1975 | Brown | 220/267 |
| 3,912,128 | 10/1975 | Ziemann et al. | 222/541 |
| 3,994,413 | 11/1976 | Smyth | 222/83 |
| 4,125,203 | 11/1978 | Sovari et al. | 220/258 |
| 4,274,563 | 6/1981 | Otterson | 222/480 |
| 4,541,541 | 9/1985 | Hickman et al. | 220/253 |
| 4,567,995 | 2/1986 | Kreiseder et al. | 220/253 |
| 4,598,837 | 7/1986 | Kreiseder et al. | 220/253 |

*Primary Examiner*—George T. Hall

*Attorney, Agent, or Firm*—Silverman, Cass, Singer & Winburn, Ltd.

[57] ABSTRACT

A closure for a container with a top cut tamper evident feature and including an overcap rotatably attached to a container end portion. The container end portion is provided with an integral, hollow raised annular rib having a first truncated end and a second, inclined end, the two ends separated by a weakened hinge portion. The overcap is provided with a raised, open-bottomed, channel with a first open end and a second inclined end forming a knife blade, the channel overlaying and engaging the raised rib so that when the overcap is rotated, the knife blade severs the rib and moves it up the inclined end. Once the entire rib is severed, the combined container end and overcap may be detached from the container by tearing the hinge. The overcap and closure may be provided with cooperating means to permit the closure to be reattached to the container.

12 Claims, 6 Drawing Figures

CLOSURE WITH TOP CUT TAMPER EVIDENT FEATURE

BACKGROUND OF THE INVENTION

1. Field of the Invention

This invention relates generally to tamper evident closures for containers, and more particularly, to a closure for such a container capable of both opening the container as well as indicating whether any tampering with the container has occurred.

2. Description of the Prior Art

Containers of the type with which the present invention is concerned include end closures which maintain the container in a sealed condition after packaging and provide a non-releasable top to indicate tampering with the container if the end closure is moved.

U.S. Pat. No. 3,261,504 discloses one type of previously known tamperproof container with a closure wherein the contents are completely sealed until a top element is turned, initiating the tearing and destruction of a tear strip by a cutting bar on the top element. This type of closure creates dispensing openings of various shapes, but upon opening is not completely detached from the container.

U.S. Pat. No. 3,463,347 discloses another closure for cans wherein a handle bar having cutting blades at each end is rotated, enabling the blades to completely sever a weakened portion in the top of the container. Since the blades are hidden under a lip, no readily ascertainable indication of tampering is provided by the structure of this patent.

U.S. Pat. No. 3,994,413 discloses an end structure for an easy open container provided with an annular guard ring having a manually adjustable punch, and a panel with a score line. To open the panel, the punch is manually pressed into the score line and the guard ring is rotated. As is the case in the previously described reference, tampering with the container is not readily evidenced.

U.S. Pat. No. 4,567,995 in the name of the same inventor as the inventor herein discloses an end closure for a container wherein an overcap with a knife blade is rotatably attached to an endcap to engage and sever a raised dispenser portion upon rotation. The raised dispenser portion provides a relatively small aperture not suitable for the free discharge of the entire contents of the container.

Thus, it is desired to provide an improved tamper evident container end closure having an easily identifiable expedient for indicating indication of tampering and also capable of opening the entire container end. The closure of the present invention includes an overcap rotatably secured to the closed end of a container and is provided with an integral channel having a knife blade at one end. Twisting of the overcap relative to the container causes the blade to engage and sever a raised hollow rib in the endcap to create a hinged lid and expose the contents for removal. Once the overcap has been rotated to any significant extent, tampering of the container is evidenced by the visible portion of the severed rib.

SUMMARY OF THE INVENTION

The invention provides a closure for a container with a top cut tamper evident feature and includes an overcap rotatably attached to a container end portion. As the overcap is rotated about the end portion, a knife blade formed in the overcap engages and severs a hollow raised annular rib in the end portion, leaving the closure secured to the container by a weakened hinge portion. The user may detach the closure from the container by tearing the hinge portion.

The overcap is rotatably attached to the end portion by an annular depending flanged member which engages a flanged recess in the end portion. The overcap also is provided with a raised annular channel having an open truncated end and an inclined end forming a knife edge surface or blade. The overcap channel overlays and engages the rib of the end portion so that, as the overcap is rotated, the raised rib is severed and forced up and over the blade's incline. Thus, when the severed rib is visible, tampering is evidenced. At the completion of rotation, the rib is totally detached from the container, leaving the closure secured to the housing by an uncut grooved hinge portion located between the ends of the raised rib. The grooves in the hinge portion weaken the same to allow the closure to be easily torn from the container.

In certain applications, it may be desirable to replace the closure upon the container after it has been detached. In such case, the container wall may be provided with an annular groove which engages an annular bead formed in the sidewall of the overcap. This arrangement allows the severed closure to be securely replaced on the container by the snap-fit of the bead within the groove.

DESCRIPTION OF THE PREFERRED EMBODIMENT

Figure 1:
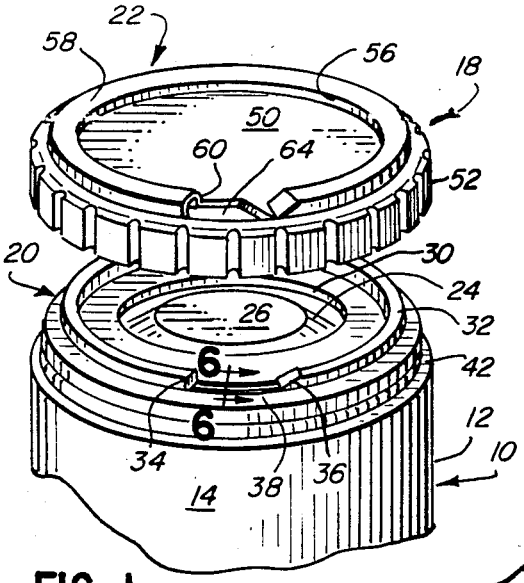
FIG. 1 is an exploded perspective view of the container closure of the invention secured to a container.

Referring to FIG. 1, a container 10 is indicated having a body 12 including a wall 14. In the preferred embodiment, the body 12 is cylindrical and straight walled in configuration, although any shape suitable for storing a desired product may be used. The container 10 is further provided with a bottom (not shown) at one end, constructed and arranged in conventional fashion to be secured to the body 12 once the container 10 has been filled with product. The bottom may be plastic or aluminum, and when installed, the contents of the container are hermetically sealed to preserve product life.

At the end opposite the bottom, the body 12 is provided with the end closure 18 of the invention. The end closure 18 has two portions, an endcap portion 20 and an overcap portion 22. The endcap 20 is provided with an annular recess 24 which defines a central boss 26. The recess 24 has an upwardly projecting annular flange 28 with an annular lip 30 (shown best in FIG. 4).

Referring to FIGS. 1–6, a raised hollow annular rib 32 is integrally formed in endcap 20. The rib 32 is provided with a first truncated end 34 and a second inclined end 36. An arcuate hinge portion 38 of endcap 20 separates truncated end 34 from inclined end 36. The arcuate hinge portion 38 is provided with at least one groove 40 which provides hinge 38 with a frangible quality. The grooves 40 are shown in greater detail in FIGS. 3 and 6. In the preferred embodiment, two grooves 40 are provided in an upwardly opening v-shaped arrangement, although the precise number and configuration of grooves 40 will depend on the particular application. In addition, endcap 20 is provided with a shoulder 42 which receives overcap 22.

The overcap 22 is provided with a generally horizontally planar lid 50 to which is integrally secured an annular, depending sidewall 52. In the preferred embodiment, the sidewall 52 is provided with a knurled exterior 54 to facilitate the rotation of the overcap 22 about the endcap 20. However, this feature forms no part of the invention; any exterior surface configuration may be used. The lid 50 of the overcap 22 is further provided with a raised, hollow annular channel 56 with a closed top 58. A first end 60 of the channel 56 is open and truncated, and a second end 62 of channel 56 is provided with an inclined surface forming a knife blade 66 at its base.

The channel 56 and its ends 60, 62 are configured and dimensioned to overlay and rotatably engage the rib 32. The first and second ends 60, 62 of the channel 56 are separated by an aperture 64 (shown in FIGS. 1 and 3).

Figure 4:
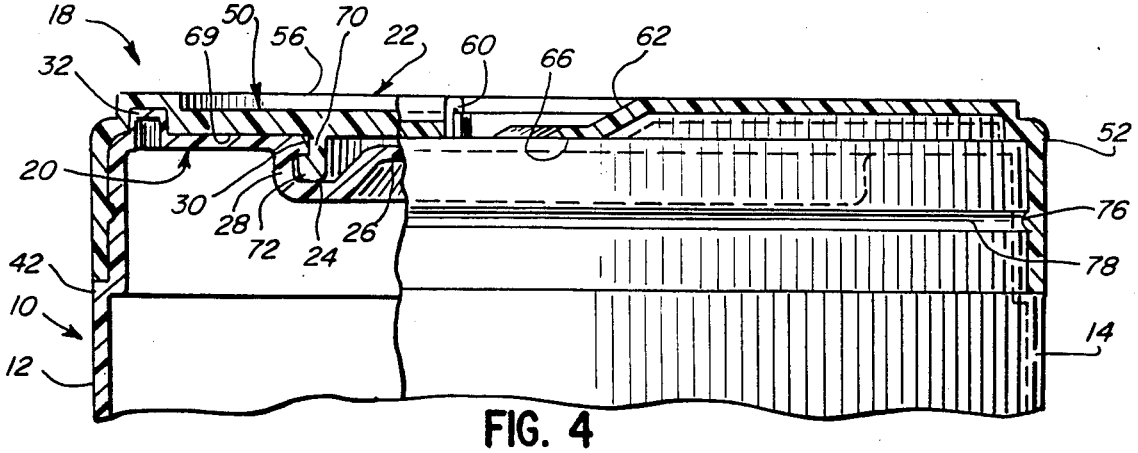
FIG. 4 is a partial sectional view of the closure of the invention.

Referring now to FIG. 4, the underside 69 of the lid 50 is provided with a vertically depending annular member 70 with a generally outwardly projecting flange 72, spaced inwardly from the underside 69. In order to rotatably secure the overcap 22 to the endcap 20, the overcap flange 72 is of a configuration which is generally complementary to the recessed flange 28 and lip 30 of endcap 20. The internal diameter of the flange 28 is greater than the external diameter of the flange 72. Since the overcap 22 and the endcap 20 are preferably manufactured of a strong resilient plastic such a polypropylene, there will be a snap fit inter-engagement between the complementary engaging faces of the flange 72 and the lip 30, which will allow the overcap 22 to rotate about the endcap 20.

Thus, once assembled, the overcap 22 is rotatably attached to the end cap 20, with the channel 56 engaging the rib 32, the open channel end 60 overlying the truncated rib end 34 and the inclined blade portion 62 overlying the inclined portion 36 of rib 32.

Referring now to FIGS. 1, 2, 3 and 5, when the closure 18 is in the sealed condition, the user must carefully examine the aperture 64 before the rib 32 may be seen. However, once the overcap 22 is rotated in the direction indicated by arrow 74, the blade 66 will engage the truncated end 34 of the rib 32. Since in the preferred embodiment, the overcap 22 may be fabricated from a homopolymer material and the endcap 20 from a relatively softer copolymer material, the blade 66 readily cuts the rib 32.

Figure 2:
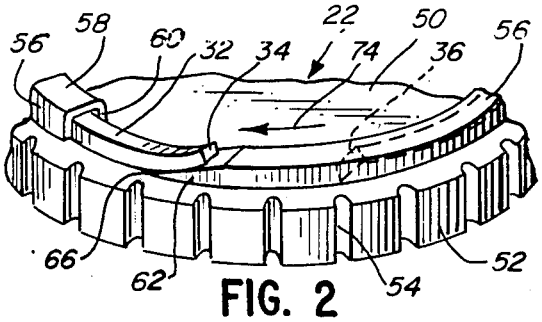
FIG. 2 is an enlarged fragmentary perspective view of the closure of FIG. 1, the same being illustrated in the condition following partial rotation of the overcap.
Figure 3:
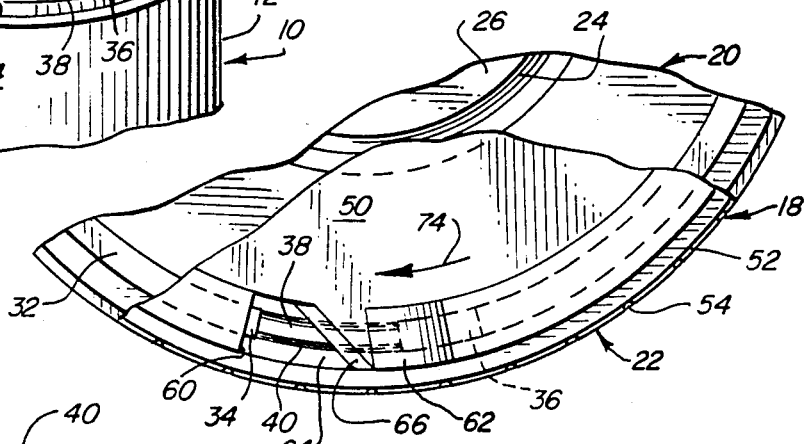
FIG. 3 is an enlarged fragmentary plan view in partial section of the closure depicted in FIG. 1.
Figure 6:
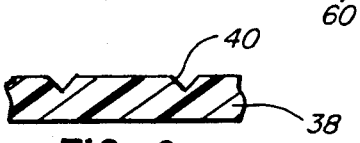
FIG. 6 is an enlarged sectional view taken along the line 6—6 of FIG. 1 in the direction indicated generally.
Figure 5:
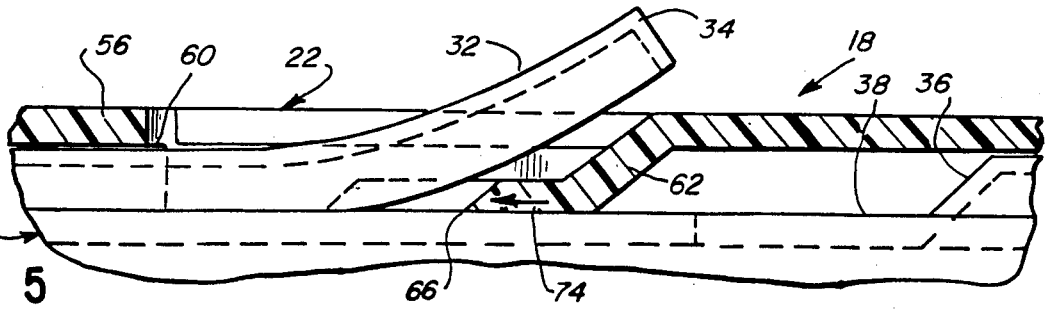
FIG. 5 is an enlarged sectional view of the closure shown in FIG. 4, the same being illustrated in the condition following partial rotation of the overcap.

As seen in FIGS. 2 and 5, as the overcap 22 rotates around the endcap 20, the severed portion of the rib 32 is forced upward along the inclined portion 62 of the channel 56. In this manner, any tampering with the closure 18 is clearly evident. The severing of the rib 32 serves another function, for as the hollow rib is severed, the seal provided by the endcap 20 is broken, and the container 10 is gradually opened.

Once the overcap 22 is completely rotated around the endcap 20, the blade 66 is stopped at the inclined end 36 of rib 32, since there is no more material to cut. At this point, the overcap 22 is rotatably held to the endcap 20 by the snap fit flanges and lip 72 and 30, and the assembled closure 18 is secured to the container body 12 only by the hinge portion 38. The user may then either discharge the contents of the container with the closure 18 attached or may remove the closure 18 by tearing the grooved hinge 38.

If desired, the overcap 22 and the container wall 14 may be provided with cooperating formations for resecuring the overcap 22 to the container 10. In the preferred embodiment, this includes an annular bead 76 formed integral with the inner circumferential surface of sidewall 52. The annular bead 76 is configured and dimensioned so as to matingly engage an annular groove 78 cut into the wall 14 of the body 12 proximate to the endcap 20. The resilient nature of the plastic material used to fabricate the body 12 and the overcap 20 provides a snap fit of the severed overcap 20 when it is positioned upon the body 12.

While the container 10 is in the sealed condition, the blade 66 will not be engaged with the raised rib 32, and no evidence of tampering is present. As the overcap 22 is rotated in the direction 74, the blade 66 engages and severs the truncated end 34 of the rib 32. Upon partial rotation, the severed portion of the rib 32 is pushed up the incline 62 of the overcap channel 56 to provide evidence of tampering.

When the overcap 22 has been completely rotated about the circumference of the container, the rib 32 is completely severed, and the closure 18 is secured to the body 12 by means of hinge 38 only. The severing of the rib 32 creates a large enough opening in the container 10 to permit the contents therein to be rapidly discharged by upending the opened container. If desired, the closure 18 can be completely separated from the container 10 by tearing the hinge portion 38.

Thus, the invention provides an improved, tamper evident end closure for a container. The parts are molded from plastic and easily assembled for use. Preferably, the overcap 22 and the blade 16 are molded from a more rigid plastic material than the endcap 20 to facilitate the severing of the raised rib 32.

The endcap portion 20 is closed and thus provides for hermetic sealing of the container after packaging. By rotating the overcap 22, the blade 66 severs the raised rib 32, allowing the closure 18 to be detached from the body 12. The hinge portion 38 secures the closure 18 to the body, unless torn by the user.

While the preferred embodiment of the invention has been shown, it will be understood that the invention may be otherwise embodied within the scope of the attached claims. Minor variations in the structure and in the arrangement and size of the various parts may occur to those skilled in the art without departing from the spirit and scope of the invention.

I claim:

1. A closure for a container comprising:

a stationary container end portion formed integral with said container;

a raised annular rib portion integral with said end portion and having an open bottom, a first truncated end and a second inclined end, said ends separated by a weakened hinge portion; and an overcap portion attached to said container end portion for coaxial rotation thereabout, said overcap having a raised, open-bottomed, closed top channel with a first open truncated end and a second, inclined end forming a knife blade, said channel configured and dimensioned to overlay and engage said annular rib, so that as said overcap is rotated about said end portion, said blade engages and severs said rib and moves said severed rib up said incline, thus severing said end portion and said overcap from said container, said closure being retained on said container by said weakened hinge portion only.

2. The closure defined in claim 1 wherein said hinge portion may be torn during said detaching of said closure, enabling the removal of said closure from said container.

3. The closure defined in claim 1 wherein said first and second ends of said channel are separated a distance codimensional with said hinge portion.

4. The closure defined in claim 3 wherein said channel ends are separated by an aperture on said overcap.

5. The closure defined in claim 1 wherein said hinge portion is provided with at least one annular groove.

6. The closure defined in claim 1 wherein said hinge is of generally arcuate configuration and separates said ends of said annular rib.

7. The closure defined in claim 1 further comprising means for reattaching said closure upon said container.

8. The closure defined in claim 7 wherein said reattaching means include an annular bead on said overcap and a matingly engagable annular groove on said container.

9. The closure defined in claim 1 wherein said overcap is rotatably secured to said end closure by an annular depending flange member in said overcap which engages an annular flanged recess in said end closure.

10. A closure for a walled container comprising:

a stationary, substantially flattened container end portion, formed integral with said container to seal the same;

a raised hollow annular rib portion integral with said end portion and having a first truncated end and a second inclined end, said ends separated by a hinge portion having at least one weakening groove therein;

an overcap portion attached to said container end portion for coaxial rotation thereabout, said overcap having a sidewall, a raised, open-bottomed closed top channel with a first open truncated end and a second inclined end forming a knife blade, said first and second ends separated by an aperture, said channel configured and dimensioned to overlay and engage said annular rib, so that as said overcap is rotated about said container end portion, said blade engages and severs said rib and moves said severed rib up said incline, thus severing said combined overcap and container end portion from said container, said closure being retained on said container by said weakened hinge portion only, until said closure is torn from said container; and said sidewall of said overcap having reattachment means for engaging said wall of said container to enable the reattachment of said severed closure upon said container.

11. The closure defined in claim 10 wherein said reattachment means include an annular bead on said sidewall of said overcap which engages an annular groove in said container wall.

12. The closure defined in claim 10 wherein said overcap is rotatably secured to said end closure by an annular depending flange member in said overcap which engages an annular flange recess in said end closure.

* * * * *